US005423446A

United States Patent [19]

Johnson

[11] Patent Number: 5,423,446

[45] Date of Patent: Jun. 13, 1995

[54] VAPOR SEAL FOR FLOATING ROOF OF LIQUID STORAGE TANK

[76] Inventor: Ronald G. Johnson, 14643 Plumosa Dr., Jacksonville, Fla. 32250

[21] Appl. No.: 49,816

[22] Filed: Apr. 20, 1993

[51] Int. Cl.[6] ..... B65D 88/34

[52] U.S. Cl. ..... 220/216; 220/221

[58] Field of Search ..... 220/216, 220, 221, 222; 73/863.81, 863.85, 864.67

[56] References Cited

U.S. PATENT DOCUMENTS

| | | | |
|---|---|---|---|
| 1,650,340 | 11/1927 | Glass | 220/221 |
| 1,674,038 | 6/1928 | Glass | 220/221 |
| 2,237,461 | 4/1941 | Tokheim | 220/221 |
| 3,366,266 | 1/1968 | Heartstedt | 220/216 |
| 3,409,165 | 11/1968 | Creith | 220/216 |
| 3,493,143 | 2/1970 | Thompson et al. | 220/222 X |
| 4,243,151 | 1/1981 | Bruening | 220/216 |
| 4,260,068 | 4/1981 | McCarthy et al. | 220/221 |
| 5,138,891 | 8/1992 | Johnson | 73/864.67 |
| 5,230,436 | 7/1993 | Vaughn | 220/220 |

*Primary Examiner*—Allan N. Shoap
*Assistant Examiner*—Vanessa Caretto
*Attorney, Agent, or Firm*—Arthur G. Yeager

[57] ABSTRACT

A tapered, tubular, flexible sheet material is provided as a vapor seal between a gauge well pipe and a gauge well sleeve of a floating roof in a liquid storage tank, the larger end of the seal being rigidly affixed to the sleeve and the smaller end of the seal slidingly disposed about the gauge well pipe which is affixed to the tank. The smaller end of the seal is connected to a circular weight supported by the sleeve via a plurality of cables within the hollow of the seal, and a plurality of spring loaded sections are connected to and between the weight and the well pipe to permit movement of the seal as the floating roof moves thus causing the sections to slide up and down on the well pipe.

20 Claims, 4 Drawing Sheets

VAPOR SEAL FOR FLOATING ROOF OF LIQUID STORAGE TANK

BACKGROUND OF THE INVENTION

Floating roofs on liquid storage tanks, particularly those storing petroleum chemical liquids, are well known. It is also well known that petroleum tanks emit vapors and odors that are not pleasant to inhale, and are increasingly violations of emissions laws and subject to governmental controls. For example, see 40 C.F.R. 60 for the U.S. Environmental Protection Agency regulations, as well as other state and local laws. Such vapors and odors are the result of inadequate vapor sealing to prevent the petroleum vapors in the storage tank from escaping to the surrounding atmosphere. Floating roofs contain the vapors from the liquid immediately under the roof, but wherever the roof does not cover the liquid, vapors are able to escape. The large area of this type is that ring between the outer edges of the roof and the wall of the tank. Single or double rings of flexible sheet material, such as rubber, are used to prevent the vapors from escaping around the edges of the roof while permitting limited lateral movement of the roof, as well as vertical movement. Another potential leak for vapors is around the gauge well pipe that is used to take samples from the stored liquid at various depths for analysis. A typical sample taking system is described in my U.S. Pat. No. 5,138,891, which is incorporated herein for reference. The present invention is an improvement upon the invention of that patent in that it provides a vapor seal system to be used to substantially prevent vapors from leaking past the gauge well pipe and beyond the roof to the atmosphere.

It is an object of the invention to provide a vapor seal for use between the gauge well pipe and the gauge well sleeve in a liquid storage tank having a floating roof that accommodates for vertical and lateral movement of such roof while an effective vapor seal is maintained. It is another object of this invention to provide such a seal of vapor-impervious flexible sheet material fastened at the upper end to the floating roof and at the lower end to a weighted shoe sliding vertically on the gauge well pipe. Still other objects will become apparent from the more detailed description which follows.

BRIEF SUMMARY OF THE INVENTION

This invention relates to a vapor sealing system for a liquid storage tank having a floating roof, a gauge well pipe affixed vertically to the tank, and a gauge well sleeve or barrel in the roof and through which the gauge well pipe passes. The improvement of this invention includes a tapered, tubular, vapor-impervious sheet material having its larger opening at the upper end fastened to the gauge well sleeve in the roof and its smaller opening at the lower end slidingly connected to the gauge well pipe. In specific and preferred embodiments of the invention the sliding connection between the lower end of the vapor seal and the gauge well pipe includes a weighted and sectionalized shoe fitting around the outside of the pipe and with the lower end of the seal tightly fastened to the shoe. The upper end of the seal is clamped around the perimeter of its opening between the gauge well sleeve outslide of the seal and a clamping ring on the inside of the seal. The shoe is suspended from the clamping ring by a plurality of cables with the weight of the shoe maintaining the seal sheet material in its loose preformed shape as the roof rises or falls with the level of the stored liquid or the roof laterally moves in the tank. More specific improvements are found in the structure of the shoe and the clamping ring.

BRIEF DESCRIPTION OF THE DRAWINGS

The invention itself, however, both as to its organization and method of operation, together with further objects and advantages thereof, may best be understood by reference to the following description taken in connection with the accompanying drawings in which.

DETAILED DESCRIPTION OF THE INVENTION

Figure 1:
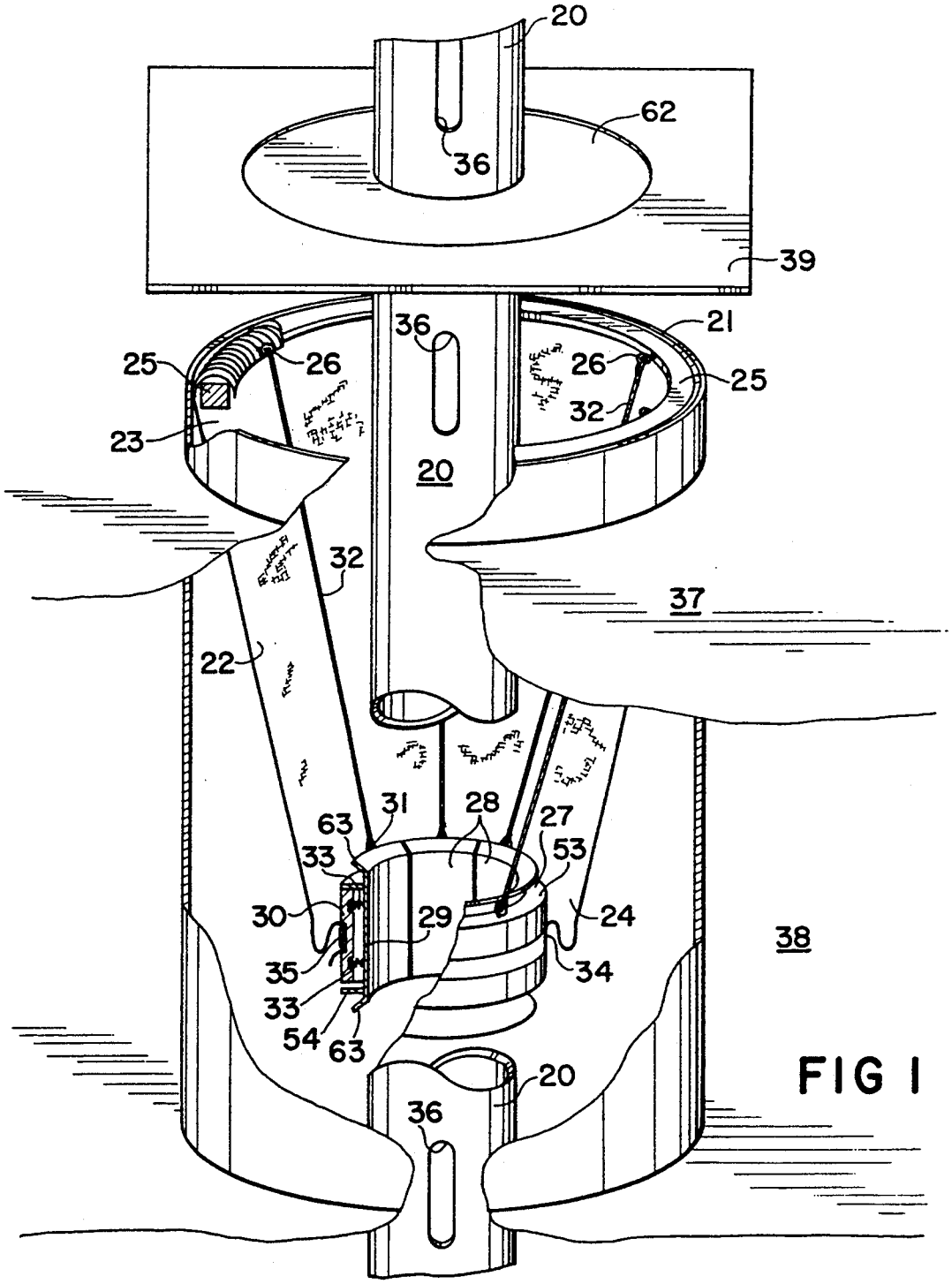
FIG. 1 is a schematic exploded and perspective view of the vapor seal of this invention installed in a liquid storage tank having a floating roof, a gauge well pipe, and a gauge well sleeve or barrel.

The features and advantages of the vapor seal of this invention are best understood by reference to the attached drawings. FIG. 1 shows the invention in use in a liquid storage tank having a floating roof.

Figure 3:
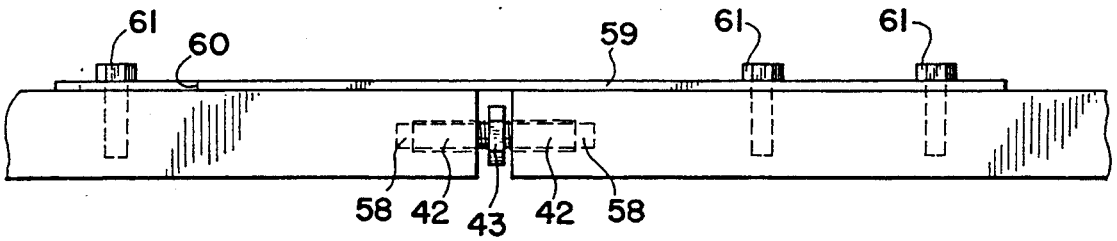
FIG. 3 is a partial side elevational view taken along line 3—3 of FIG. 2.

Storage tanks (see FIG. 3 of my U.S. Pat. No. 5,138,891) are normally cylindrical tanks of a large diameter and have an open top into which a floating roof is placed to float on the surface of the stored liquid moving up and down as the liquid level changes. The floating roof is usually constructed of two horizontal, spaced, parallel steel plates 37 and 38 with a framework of load supporting beams holding plates 37 and 38 in their respective locations. Around the edges of the roof there is an annular space between the roof and the tank walls where vapors from the liquid can escape unless a seal is employed. The usual type of seal is to use one or two flexible rubber sheets outwardly extending from the roof edge to engage the nearby cylindrical wall. In addition the storage tank contains a vertical gauge well pipe 20 which is affixed to the tank and extends from the bottom of the tank to an inspection platform above the roof. Samples of the stored liquid are taken by lowering a sample container (not shown) inside the gauge well pipe 20 to a selected level. Slots 36 in pipe 20 are used to assure adequate mixing of the stored liquid so that the sample taken in pipe 20 will be truly representative of the liquid at that level elsewhere in the tank. A gauge well sleeve or barrel 21 is built into the floating roof to provide unobstructed free movement with respect to well pipe 20. A cover 39 is placed over the top of sleeve 21 and includes an enlarged oval shaped hole 62 to provide lateral clearance for lateral movement of the roof without touching pipe 20 and/or to accommodate for irregularities in the plates forming the cylindrical wall of the tank. Because of the clearance between pipe 20 and sleeve 21 there is an annular space which will permit vapors to escape from the liquid to the atmosphere. It is a principal object of this invention to provide an effective vapor seal for this space which may be installed without draining the tank.

The vapor seal is a truncated or tubular, tapered and flexible sheet material 22 affixed at its upper larger end 23 to sleeve 21 and slidingly attached at its lower smaller end 24 to gauge well pipe 20. If, as is the usual case, sleeve 21 and pipe 20 are both circular, the vapor Seal has a truncated conical shape with the larger opening at upper end 23 and the smaller opening at lower end 24. The sheet material of vapor seal 22 must be vapor-impervious and may be leather, plastic, rubber, or the like, but, preferably, is a woven fabric of polyester and nylon and is coated with polyurethane to make an overall thickness of about 21 mils (0.021 inch).

Figure 2:
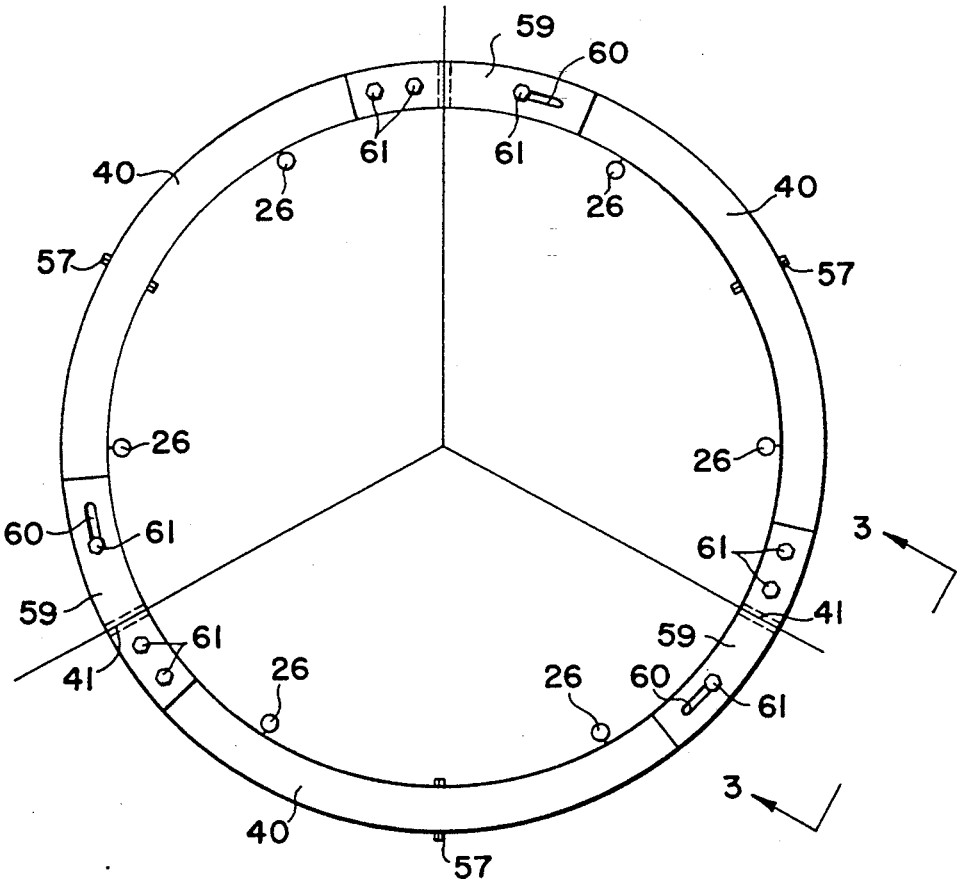
FIG. 2 is a top plan view of the clamping ring of this invention.

At upper end 23 vapor seal 22 is immovably attached to sleeve 21 by means of a clamping ring 25 (shown in detail in FIGS. 2–3). Vapor seal 22 is sandwiched between sleeve 21 on the outside of seal 22 and clamping ring 25 on the inside of seal 22. The detailed drawings (FIGS. 2–3) of clamping ring 25 show it to be comprised of three identical arcuate sections 40 which meet at junctures 41 and are held together by bridge plates 59 and turnbuckle studs 42. It is, of course, not critical that sections 40 be three in number or that they are identical, although three identical sections are preferred. Bridge plates 59 extend over,junctures 41 and are affixed to sections 40 by screws or bolts 61. A slot 60 is included to permit some flexibility in movement of sections 40 as they are expanded or contracted. At each juncture 41 there is a stud 42 engaged in tapped holes 58 in the adjoining sections 40 which can be turned by nut 43 welded to stud 42. By appropriately selecting left- and right- hand threads for studs 42 and tapped holes 58 it can be arranged that turning nut 43 in one direction causes adjacent sections 40 to move away from each other, and, contrariwise, turning nut 43 in the other direction causes adjacent sections 40 to move toward each other. Because of this arrangement, clamping ring 25 can be placed inside of upper end 23 of vapor seal 22 as it is placed inside of sleeve 21 and by appropriate turning of nuts 43 clamping ring 25 can be made to expand and thereby clamp vapor seal 22 tightly between clamping ring 25 and sleeve 21. When the expansion of clamping ring 25 is completed set screws 57 are extended to cause clamping ring 25 to be firmly attached to sleeve 21 and to assure a continuity of grounding the ring 25 to sleeve 21, sleeve 21 and the roof being properly grounded. It should be noted that there are two spaced eye bolts 26 on each section 40 which serve to anchor the upper ends of cables 32 to sleeve 21.

Figure 4:
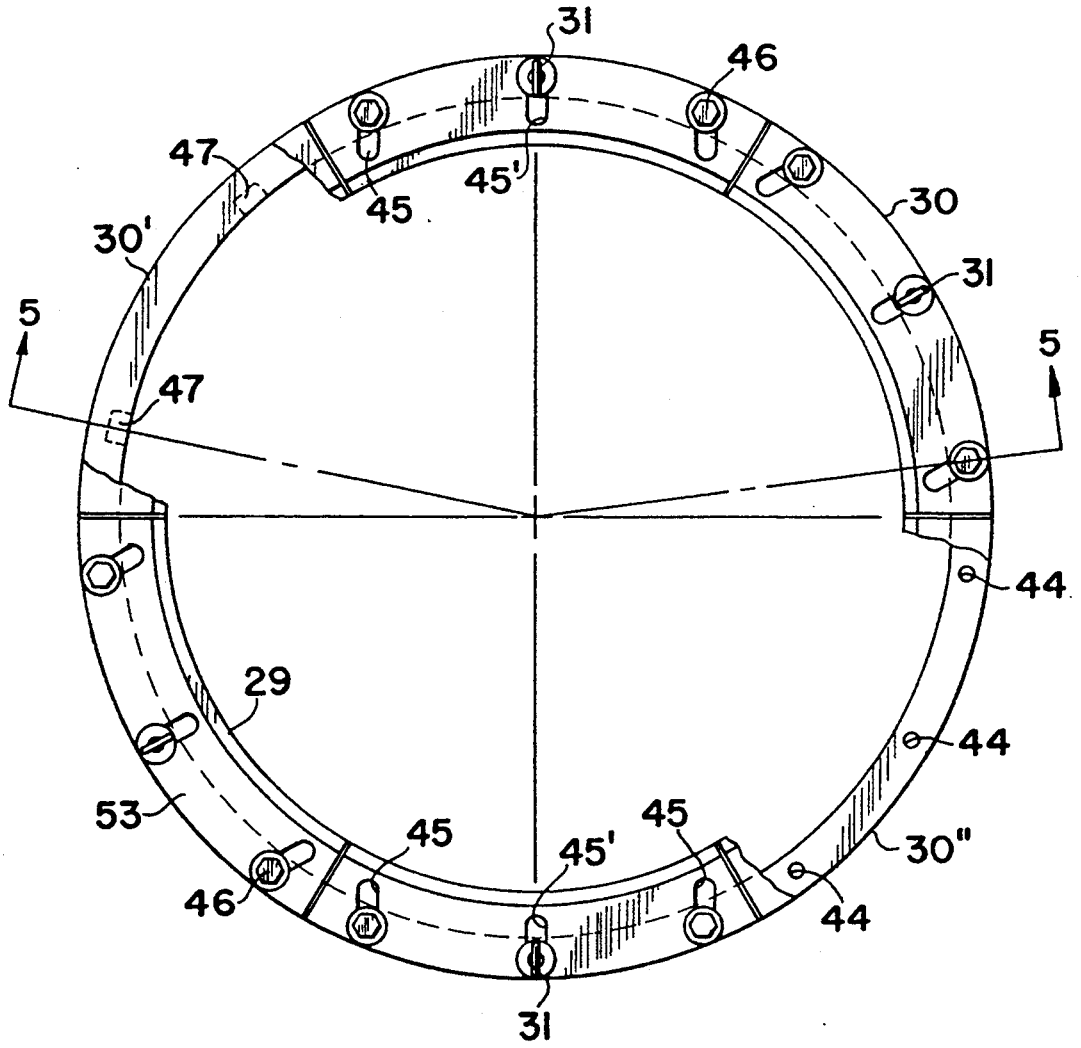
FIG. 4 is a top plan view of the sliding shoe of this invention.
Figure 5:
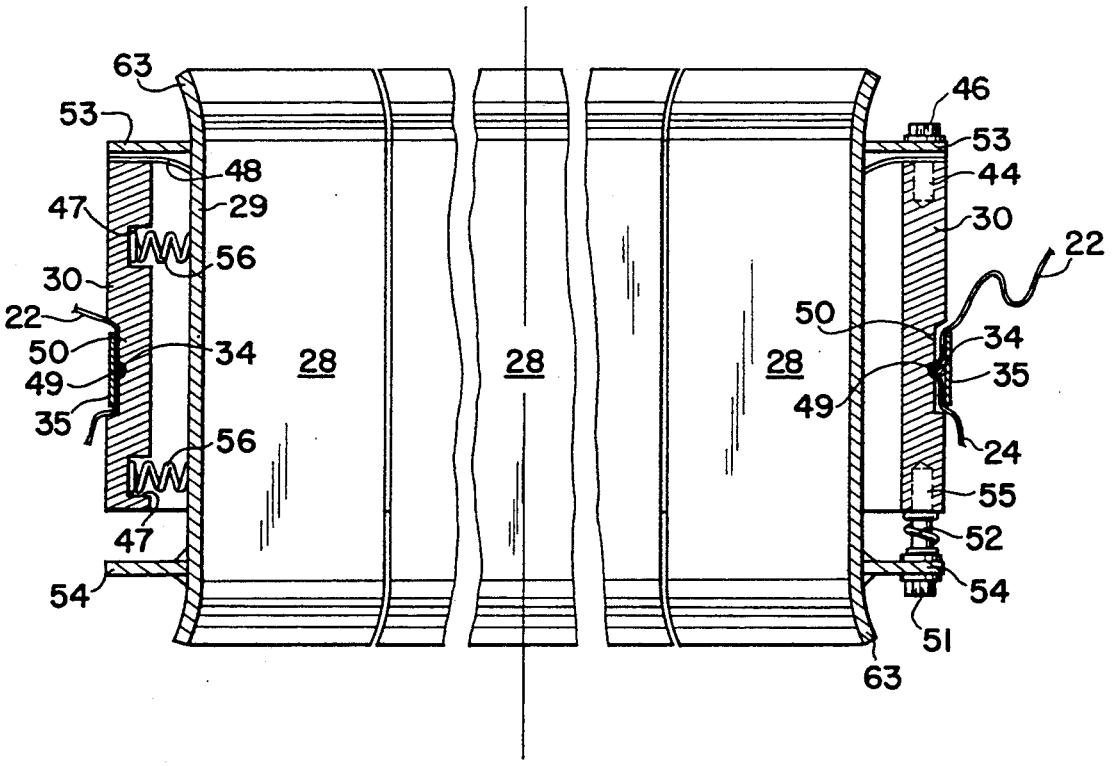
FIG. 5 is a cross-sectional view taken along line 5—5 of FIG. 1.

The lower end 24 of vapor seal 22 is firmly connected to shoe 27 which is built to fit snugly, but slidingly, around the outside of gauge well pipe 20. Shoe 27 is .preferably constructed of a plurality of sections 28, preferably six (6) identical sections 28 as seen in FIGS. 4 and 5. Preferably shoe 27 is made of metal, such as non-spark producing brass, or the like, and has smoothly rounded upper and lower ends so as to minimize the possibility of shoe 27 becoming cocked and no longer slidable up and down the outside of pipe 20 and over any burrs that might be present around slots 36. As may be seen, the upper and lower ends of each section 28 has an outwardly tapered flange 63 to allow shoe 27 to ride smoothly over any obstruction on the outside of pipe 20.

Each section 28 of the shoe 27 includes an inner thin member 29 and a part of an outer thick weight member 30. Weight member 30 is formed of two semi-circular halves 30' and 30'' which are bolted or otherwise rigidly joined together. Each half member 30' and 30'' are supported by three (3) cables 32 connected to eye bolts 31 which are affixed to the top of the weight. The members 29 and 30 are held together by a plurality of upper screws 46 passing through upper flanges 53 and engaged with upper tapped holes 44; and lower screws 51 passing through lower flanges 54 and engaged with lower tapped holes 55. There is no critical number of screws 46 and 51, although two of each per section 28 is preferred with an eye bolt 31 spaced therebetween in each section 28. Springs 52 around lower screws 51 provide some vertical flexibility for shoe 27. Lateral grooves 49 and 50 on the outside of the weight member 30 provide a seat for a rubber O-ring 34 and clamping belt or strap 35. Lower end 24 of vapor seal 22 is placed between O-ring 34 .and weight member 30 with clamping strap 35 placed around O-ring 34 to form a tight vapor-proof seal when the clamping strap 35 is tightly secured in place. Generally, strap 35 may be made from two semicircular pieces with flanged ends which are bolted together. Each section 28 also has a plurality, preferably four (4), of spaced recesses 47 in the weight members 30 for steel springs 56 to bias thin section 29 inwardly against the gauge pipe 20. Because there is a space between thick sections 30 and thin sections 29 which might serve as an escape route for vapors, shoe 27 includes flap seal 48 which is a flexible sheet extending from thick section 30 to thin section 29 and accommodates for inward and outward movements of the thin sections 29. The material for flap seal 48 may be the same as or different from that of vapor seal 22. As may be seen in FIG. 4 each section 28 includes an eye bolt 31, thus providing a lower anchor for six (6) cables 32 extending up to eye bolts 26 on clamping ring 25. The flanges 53 and 54 are slotted at 45 of each section 28, in a direction substantially parallel to the radial direction of the slot 45' through which the eye bolt 31 extends thus permitting limited lateral movement of each section 28 toward and away from gauge well pipe 20 as the shoe 27 moves upwardly and downwardly as the roof moves vertically.

The weight of shoe 27 should be sufficient to extend cables 32 to a reasonable tautness at all times so that as the floating roof moves up and down shoe 27 will likewise move up and down on the gauge well pipe 20 and there is no weight except the weight of the fabric itself on the vapor seal 22.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a system including a floating roof on a liquid storage tank having a vertical gauge well pipe having an outside surface and being affixed to the tank and a gauge well sleeve affixed to the roof concentrically around the gauge well pipe, an improved vapor seal between said gauge well pipe and said gauge well sleeve which comprises a vapor-impervious tubular generally conical fabric seal having an outside and inside surface and an upper end of larger opening immovably attached to said gauge well sleeve tapering inwardly to a lower end of smaller opening spaced remotely downwardly from said larger opening and being slidingly attached to said gauge well pipe.

2. The system of claim 1 wherein said lower end of said fabric seal is affixed to a cylindrical tubular shoe positioned concentrically and slidably around said outside surface of said gauge well pipe.

3. The system of claim 2 wherein said shoe is suspended by a plurality of cables attached to said shoe at a lower end of each said cable and to said sleeve at an upper end of each said cable.

4. The system of claim 3 wherein said shoe functions as a weight to provide tautness to said cable.

5. The system of claim 2 wherein said shoe includes a plurality of thin arcuate inner sections, each cooperating with a thick outer concentric section having a groove on the outside thereof aligned with a similar groove on each adjacent said outer section and forming a combined groove therewith and being overlaid by said lower end of said fabric seal and held in position by an O-ring seal on said outside surface of said fabric seal, and a tightenable ring clamp about said O-ring seal.

6. The system of claim 2 wherein said upper end of said fabric seal is clamped between said gauge well sleeve on the outside surface of said fabric seal and an expandable ring on said inside surface of said fabric seal.

7. The system of claim 5 wherein said shoe contains six pairs of said inner sections and said outer sections, each said pair being attached to one said cable.

8. The system of claim 6 which additionally comprises a planar ring shaped flexible vapor seal extending horizontally between said inner section and said outer section.

9. A vapor seal system for use in a liquid storage tank having a floating roof and a vertical fixed gauge well pipe having an outside surface and passing through a vertical opening in a sleeve in said roof, the system comprising a flexible, vapor-impervious, tapering tubular seal member having a large opening at an upper end thereof affixed to said roof sleeve and a small opening at a lower end thereof slidingly attached to said gauge well pipe, the connection between said sleeve and said seal member including an expandable ring clamp sandwiching said seal member between said ring clamp and said sleeve in a non-slidable condition; the connection between said seal member and said gauge well pipe including a sectionalized tubular shoe positioned concentrically and slidably around said outside surface of said gauge well pipe and a clamping means to clamp said lower end of said seal member to said shoe in a vapor leak proof manner, and a plurality of cable members each having an upper and lower end; said upper ends of said cables being attached to said expandable ring and said lower ends being attached to said shoe, said shoe having an outside surface and being of a sufficient weight to maintain said cables reasonably taut.

10. The system of claim 9 wherein said clamping means includes a groove around said outside surface of said shoe, an O-ring to be seated in said groove with said seal member sandwiched between said groove and said O-ring and a ring clamp encircling said O-ring.

11. The system of claim 9 wherein said expandable ring clamp includes three arcuate portions, which, when joined together, result in a circular ring; and turnbuckle means on each of two adjacent said arcuate portions for expandingly connecting each said portion to its adjacent portion.

12. In a liquid storage tank including a floating roof, a vertical gauge well pipe affixed to the tank, and a gauge well sleeve affixed to the roof concentrically around the gauge well pipe, the improvement comprising vapor seal means disposed between the gauge well pipe and the gauge well sleeve, said vapor seal means including a vapor-impervious tubular fabric seal having an upper end portion of an enlarged opening tapering inwardly and downwardly to a lower end portion of a reduced opening spaced remotely downwardly from said enlarged opening, said upper end portion being affixed to the gauge well sleeve, said lower end portion being disposed with said reduced opening surrounding the gauge well pipe and being slidingly attached to the gauge well pipe, said seal being generally conical in shape.

13. The tank of claim 12 further comprising a cylindrical tubular shoe positioned concentrically in said reduced opening and affixed to said lower end portion, said tubular shoe being slidable longitudinally of the gauge well pipe.

14. In the tank of claim 13 further comprising a plurality of spaced and elongated cables having upper and lower ends, said lower end of each said cable being attached to said tubular shoe and said upper end of each said cable being supported by said sleeve.

15. In the tank of claim 14 further comprising a weight means carried by said tubular shoe to provide tautness to said cables and to maintain said fabric seal properly positioned between said sleeve and said tubular shoe.

16. In the tank of claim 13 wherein said tubular shoe includes a plurality of thin arcuate inner sections, each cooperating with a thick arcuate outer section, each said arcuate outer section having an outside surface with a groove on each said outer section being aligned with a groove on an adjacent said outer section, all of said grooves of said outer sections receiving said lower end portion of said fabric seal, an O-ring seal overlying said lower end portion of said fabric seal located in all said grooves, and a tightenable ring clamp overlying said O-ring seal to rigidly maintain said fabric seal attached to said tubular shoe.

17. In the tank of claim 16 wherein said tubular shoe contains six pairs of said inner sections and said outer sections, each said pair being attached to one said cable for supporting said pair from said sleeve.

18. In the tank of claim 13 further comprising an expandable ring means for frictionally clamping said fabric seal to said gauge well sleeve and being disposed spacedly from said gauge well sleeve, said upper end of said fabric seal being positioned between said gauge well sleeve and said expandable ring means.

19. In the tank of claim 18 wherein said tubular shoe includes inner sections and outer sections, a planar ring shaped flexible vapor seal connected to said outer sections and extending generally horizontally between said outer sections and said inner sections.

20. In the tank of claim 18 wherein said expandable ring means for frictionally clamping said fabric seal includes three arcuate sections and three extendable and retractable members respectively located between and affixed to adjacent said arcuate sections.

* * * * *